United States Patent [19]

Gnesa

[11] 4,271,969

[45] Jun. 9, 1981

[54] PORTABLE LONG BARREL FIREARM STAND FOR RIFLE OR SHOTGUN

[76] Inventor: Edward C. Gnesa, 2711 Ocotillo, Santa Maria, Calif. 93454

[21] Appl. No.: 17,190

[22] Filed: Mar. 5, 1979

[51] Int. Cl.[3] ..... A47F 7/00

[52] U.S. Cl. ..... 211/64; 248/156; 248/544

[58] Field of Search ..... 211/64, 4, 8; 70/57, 70/58, 59, 62; 248/544, 156, 545, 169

[56] References Cited

U.S. PATENT DOCUMENTS

| | | | |
|---|---|---|---|
| 321,930 | 7/1885 | Wunderlick | 211/64 |
| 2,448,456 | 8/1948 | Niskanen et al. | 248/544 X |
| 3,136,510 | 6/1964 | Bowers et al. | 248/156 X |
| 3,341,200 | 9/1967 | Brandley | 248/156 X |
| 3,477,587 | 11/1969 | Hart | 211/64 |
| 3,802,612 | 4/1974 | Smith | 211/64 X |
| 3,841,594 | 10/1974 | Zinn | 248/169 |
| 3,952,878 | 4/1976 | Gorham | 211/64 |
| 4,018,339 | 4/1977 | Pritz | 211/64 X |
| 4,089,423 | 5/1978 | Gorham et al. | 211/64 |
| 4,144,971 | 3/1979 | Balibrea | 211/64 |

*Primary Examiner*—Roy D. Frazier

*Assistant Examiner*—Robert W. Gibson, Jr.

*Attorney, Agent, or Firm*—Daniel J. Meaney, Jr.

[57] ABSTRACT

A portable long barrel firearm stand adapted for use with a rifle or shotgun having a barrel and a fixed stock, wherein the stand includes an elongated support member having a hollowed out central area and an exterior which terminates at one end in a pointed stud and at the other end which terminates in an aperture which defines a locking guide surface, a guide and alignment support which is formed into a substantially U-shaped member having a long leg and a short leg, the long leg of which is adapted to be inserted into and passed through the aperture defining the locking guide surface and slideably moveable within the hollowed out central area and the short leg of which is formed into an alignment member spaced a predetermined distance from the elongated guide support which is equal to the distance required to enable a firearm having a barrel and fixed stock to be held substantially parallel to the axis of the elongated support member, a conical shape, self-aligning support member affixed to the short leg and adapted to be inserted into the opening of the barrel and a butt support member fixedly mounted to the elongated support member above the pointed stud is shown.

9 Claims, 10 Drawing Figures

Fig_1
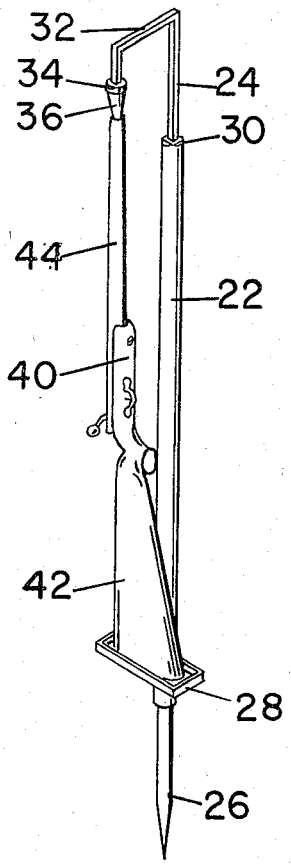
Fig_2
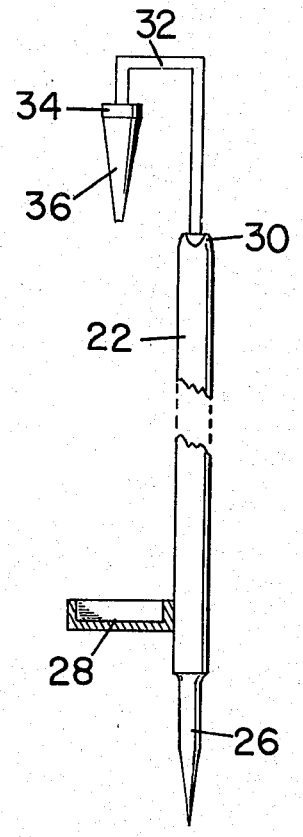
Fig_4
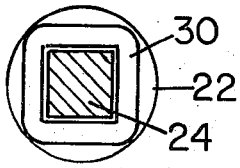
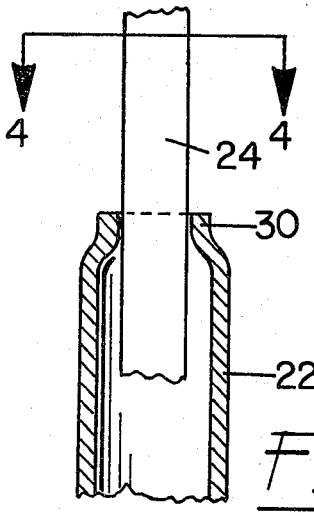
Fig_3
Fig_6
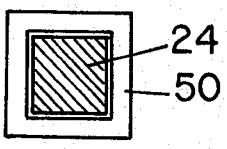
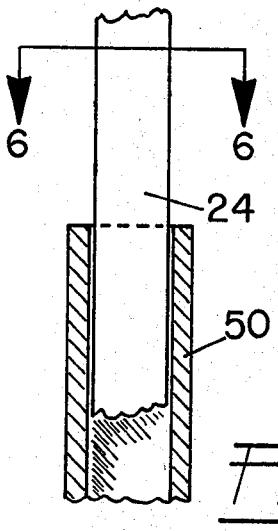
Fig_5

PORTABLE LONG BARREL FIREARM STAND FOR RIFLE OR SHOTGUN

BACKGROUND OF THE INVENTION

1. Field of the Invention

This invention relates to a portable long barrel firearm stand adapted for use with a rifle or a shotgun having a barrel and a fixed stock wherein the barrel of the firearm is supported at one end by a conical shaped self-aligning support member and at the other end by a butt end of the fixed stock. This invention is adapted for use in temporarily storing a firearm in a field or target shooting environment wherein the stand is adapted to be inserted into and supported by the earth in a vertical position and the firearm is supported in a substantially vertical position by the portable firearm stand.

2. Description of the Prior Art

It is known in the art to provide a foldable and collapsible portable stand to support a firearm in the field. Such portable stands are described in U.S. Pat. Nos. 4,089,423 and 3,952,878. It is also known in the art to provide a secured firearm rack wherein the firearm is locked in place to prevent unauthorized removal of the same from the rack. Typically, such racks include means for restraining the barrel at one end and the butt stock at the other end of a fixed stock. Typical of such patents disclosing such racks are shown in U.S. Pat. Nos. 4,018,339 and 3,917,071.

It is also known in the art to provide a gun rack which is adapted to hold a plurality of firearms wherein the firearms are stored in a substantially vertical position. Such gun racks are shown in U.S. Pat. Nos. 2,869,729, 1,202,588 and 505,320. A collapsible firearm stand having a telescopic support member which folds into a top member is disclosed in U.S. Pat. No. 3,007,581. A portable musket rack and a means for restraining a rifle at the barrel at one end thereof and at the butt section at the other end thereof is likewise shown on U.S. Pat. No. 321,930.

In addition, it is also known in the art to utilize shaped holding devices for a plurality of objects such as, for example, potted plants as shown on U.S. Pat. No. 4,071,976, a receptacle holder for glasses or the like having a fixed insert member cooperating with the orifice of a device such as a glass as shown on U.S. Pat. No. 2,936,149 and a slideable holding device for a milk bottle shown on U.S. Pat. No. 898,222.

The firearm racks and storage devices described above generally provide a means for restraining a firearm such as a rifle. Typically, the firearm is restrained at one end thereof by a holding device which cooperates with the exterior of the barrel such as that shown in U.S. Pat. Nos. 3,952,878, 3,917,071, 3,007,581, 2,869,729 and 505,320. In addition, the known devices include a butt support plate which equipment restrains the firearm at the butt end of a fixed stock.

Certain of the known prior art devices include means for restraining the firearm at the barrel end thereof which includes means which cooperate with the opening of the barrel. Examples of such devices include U.S. Pat. No. 4,018,339 which utilizes a shaped pin having a tapered shank for a combination of different sizes of bores of the rifle and U.S. Pat. No. 1,202,588 which discloses a device having an inverted cap into which the muzzle is placed and the muzzle is restrained by a fastener inserted into the opening of the muzzle.

Other variations of a rifle stand include a rifle stand which supports the butt end of the fixed stock of a firearm with a butt plate and a butt support member which engages and supports the firearm at the upper end of a stock which is shown on U.S. Pat. No. 4,089,423.

The firearm stands and racks of the prior art are not satisfactory for providing a rugged, stable and easy to use portable stand for hunting or target shooting in the field. In addition, each of the part devices include a large number of individual components to make the device usable as a portable stand or as a secured rack.

Of the prior art devices, the firearm stands disclosed in U.S. Pat. Nos. 4,089,423, 3,952,878, 3,007,571 and 2,869,729 include a spike or rod which is adapted to be inserted into the earth for supporting the gun rack. Each of the devices includes a butt plate for cooperating with the butt end of the fixed stock, but utilizes a means which cooperates with the exterior of the barrel and/or the stock for supporting the firearm in an upright position. In such devices, the bore or opening of the muzzle or barrel is exposed such that rain, dirt or other foreign objects could be dropped in the opening thereof.

In addition, in the event of a shotgun having two barrels, none of the prior art devices provide any means for covering a shotgun having two barrels either in a side-by-side arrangement or an over-and-under arrangement.

For the above reasons, the known portable firearm stands are not entirely satisfactory for use in the field for supporting a rifle or a shotgun. The portable long barrel firearm stand of the present invention eliminates certain of the disadvantages of the prior art devices and provides many additional advantages heretofore not available in a single portable long barrel firearm stand adapted for use with a rifle or shotgun, which shotgun may be either a single or double barrel gun.

SUMMARY OF THE INVENTION

This invention relates to a portable long barrel firearm stand adapted for use with a rifle or shotgun having a barrel on a fixed stock. In use, the portable firearm stand of the present invention can be inserted directly into the earth by means of the pointed spike. Alternatively, an adjustable, removable set of legs can be utilized with the portable firearm stand, which legs cooperate with the pointed stud to provide a triangular support stand. The triangular stand is adapted for supporting the portable firearm stand on either hard earth or on a solid base such as concrete asphalt or the like.

The portable firearm stand is used by placing the butt end of a fixed stock of a firearm into the fixed butt support, pulling a U-shaped guide and alignment support to a sufficient height from within an elongated support member, positioning a conical shaped, self-alignment member attached to the U-shaped member in substantial alignment with the opening of the barrel and moving the U-shaped member into the elongated support member positioning the conical alignment member in sealing engagement with the opening of the barrel. The guide and alignment support is substantially U-shaped and has an extended guide support leg which cooperates with a shaped opening in the extended support member which defines a locking guide surface. The locking guide surface cooperates with the exterior surface of the guide leg of the U-shaped member to prevent rotation of the guide support relative to the elongated support member in response to a moment of force developed by the weight of the firearm being supported thereby.

One advantage of the present invention is that the portable long barrel firearm stand comprises two movable parts; namely, an elongated support member having a butt support member affixed thereto and a U-shaped guide and alignment support having an elongated guide support which is inserted into and slides within the elongated support member and a shorter leg which has affixed thereto a conical shaped, self-aligning support member, the base being affixed to the shorter leg and the pointed end of the cone being adapted to cooperate with the opening in the barrel or muzzle of the firearm to act as a support point and concurrently a method of sealing the barrel opening. The portable firearm stand can be constructed of steel, aluminum or other material so that it can be durable and easy to use in the field.

Another advantage is that a pair of support legs can be added to the portable firearm stand. The support legs cooperate with the pointed stud, adapted to be inserted into the earth, to provide a triangular shaped support system for supporting the portable firearm stand with the firearm mounted therein.

Yet another advantage of the present invention is that a hook support can be attached to the upper end of the elongated support member which is capable of supporting an ammunition belt, jacket or other object.

A further advantage of the present invention is that the exterior of the extended support member including the butt support member can be encapsulated or coated with a thin layer of resilient material, such as rubber, to prevent scratching, marring or otherwise damaging the surface of the fixed stock or barrel of the gun.

Still, another further advantage of the present invention is that the portable firearm stand can be used to support either a rifle or a double barrel shotgun. The double barrel shotgun can be either a side-by-side configuration or an over-and-under configuration. A resilient dust cap is provided for covering both barrels of a double barrel shotgun, in either a side-by-side configuration or an over-and-under configuration. In such a portable firearm stand, the conical shaped, self-aligning support member conical sides support the shotgun by means of one of the two barrels while the dust cap is adapted to cover both barrels.

BRIEF DESCRIPTION OF THE DRAWINGS

The foregoing and other advantages, objects and features of the invention will be apparent from the following description of the preferred embodiment of the invention which considered together with the illustrations and accompanying drawings include the following figures:

FIG. 1 is a perspective view of the preferred embodiment of a portable long barrel firearm stand of the present invention shown supporting a rifle having a barrel and a fixed stock;

FIG. 2 is a front plan view of a portable firearm stand of the present invention;

FIG. 3 is a partial cross-sectional view showing the relationship between the elongated guide support and the hollowed out central area of the elongated support member which terminates in an aperture defining the locking guide surface;

FIG. 4 is a top sectional view taking along Section Lines 3—3 of FIG. 3;

FIG. 5 is a partial cross-sectional view of another embodiment of FIG. 3 wherein the elongated support member has a rectangular cross section which defines a rectangular locking guide surface and the elongated guide support member which is likewise rectangular in cross section;

FIG. 6 is a top cross-sectional view taken along Section Lines 6—6 of FIG. 5;

DESCRIPTION OF THE PREFERRED EMBODIMENT

Figure 7:
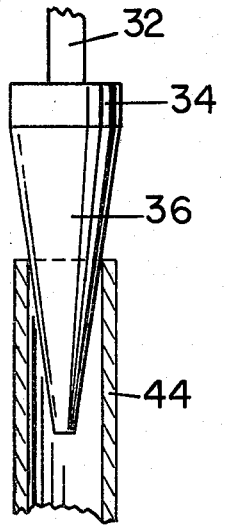
FIG. 7 is a pictorial representation, partially in cross section, showing the relationship between the conical shaped, self-aligning support member and barrel of a rifle.

FIG. 1 shows a portable long barrel firearm stand adapted to be used with a rifle or shotgun, the specific example being shown in FIG. 1 is that of a rifle. The portable firearm stand includes an elongated support member 22 having a hollowed out central area extending axially therethrough. The support member terminates at one end thereof in a pointed stud 26. The other end of the elongated support member terminates in an aperture 30 defining a locking guide surface. The aperture 30 defines the locking guide surface in a plane substantially perpendicular to the axis of the hollowed-out central area within the elongated support housing 22. A guide and alignment support member 32 is formed in a substantially U-shaped configuration wherein one leg of the U-shaped member 24 is an elongated guide support having external cross section which is adapted to be inserted into and passed through the aperture 30. The elongated guide support leg 24 slideably moves within the hollowed-out central area of the elongated support member 22. The other leg of the U-shaped member forms an alignment support which is substantially shorter than and spaced a predetermined distance from the elongated support leg 24. The predetermined distance is determined by the length of base member 32, that distance being selected to be equal to the distance required to enable a firearm having a barrel on a fixed stock to be held substantially parallel to the axis of the elongated support member 22.

A conical shaped, self-aligning support member 34 is affixed to the alignment member leg 32 and is adapted to engage the barrel 44 of a firearm 40. The conical-shaped, self-aligning support member includes a conical portion 36 which is adapted to be inserted into the opening of barrel 44 for supporting the barrel and concurrently aligning the firearm 40 in a substantially parallel relationship to the center axis of the elongated support member.

A butt support member 28 is attached to the extended support housing 22 at a point above the end of the pointed stud 26. The butt stock of a fixed stock 42 is positioned to engage and be supported by the butt support member 28.

FIG. 2 illustrates in greater detail the various components including the elongated support member 22, the U-shaped guide and alignment support 32 and the conical support member 34. In the preferred embodiment, the apex of cone 36 is less than 30°.

In FIG. 2, the butt support member 28 includes a raised edge around the periphery thereof to hold the butt end of the fixed stock in position.

FIG. 3 shows the detail in the relationship between the elongated support member 22, the elongated guide member leg 24 and the aperture 30. In the preferred embodiment, the cross section of the elongated support member 22 is circular and defines the hollowed out central area. The extended guide support leg 24 slideably moves within the hollowed out central area defined within the extended support member 22. The aperture 30 is formed by crimping the aperture 30 into a rectangular shape to conform with the rectangular shape of the elongated guide member 24. It is necessary that the elongated guide member be rectangular only in the area cooperating with the aperture 30. The aperture 30 defines a locking guide surface in a plane substantially perpendicular to the axis of the hollowed out central area.

The relationship between the elongated guide member 24 and the elongated support member 22 is important in order to prevent rotation of the guide support member 24 relative to the elongated support member 22 which is due to a rotational movement applied thereto by the weight of the firearm 40. When the conical support member 34 is positioned into the opening of barrel 44, a rotational moment is developed around the aperture 30 which would have the tendency to cause the barrel of the firearm to tip forward causing rotation of the U-shaped and alignment member 32 about the centerline of the elongated support member 22. By forming a rectangular shaped surface within aperture 24, a guide locking surface is produced which retards the rotation due to the couple developed by the weight of the firearm 40.

FIG. 7 shows in greater detail the conical shaped, self-aligning support member 34 positioned within the barrel 44. The conical shaped surface 36 sealingly engages the interior surface of the barrel 44 to form a seal between the edge of the conical shaped member 36 and the interior of the barrel 44.

Figure 8:
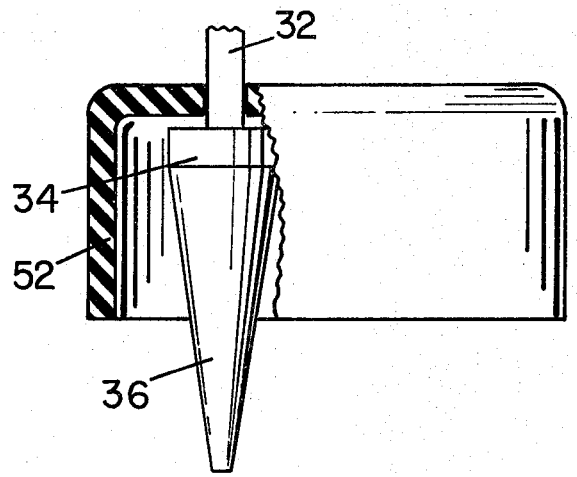
FIG. 8 is a pictorial representation, partially in cross section, showing a dust cap cover adapted for use with a double barrel shotgun.

FIG. 8 shows an oblong shaped dust cap member 52 which is adapted for use with a double barrel shotgun. In this embodiment, the dust cap has a flat cap surface and a raised outer surface 52 which defines a rim around the periphery of the flat cap surface and the rim extends toward the butt support member. The dust cap 52 is positioned to have alignment member 32 passed therethrough. If the shotgun is a side-by-side arrangement, the dust cap 52 is formed of the desired geometrical cross-section and is adapted to be rotated to accommodate the side-by-side relationship. If the shotgun is an over and under barrel arrangement, the dust cap 52 can be rotated to facilitate such double barrel shotgun.

Figure 9:
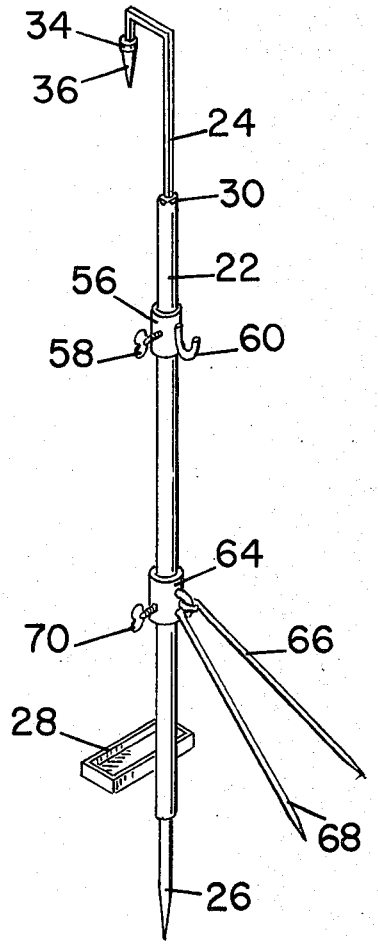
FIG. 9 is a pictorial representation of a portable firearm stand having additional support legs and rack member.

FIG. 9 shows the addition of a number of additional options. An adjustable leg support means 64 having a pair of U-shaped legs 66 and 68 is positioned on the elongated support member 22. A thumb nut 70 is provided as a means for securing the legs 66 and 68 to elongated support member 22 above the butt support member 28 in order to form a triangular-shaped support formed of the pointed stud 26 and ends of the legs 66 and 68.

Also, an adjustable rack means 56 having a thumb nut 58 and a hook member 60 can be used for supporting ammunition belts, coats or the like from the portable firearm stand.

Figure 10:
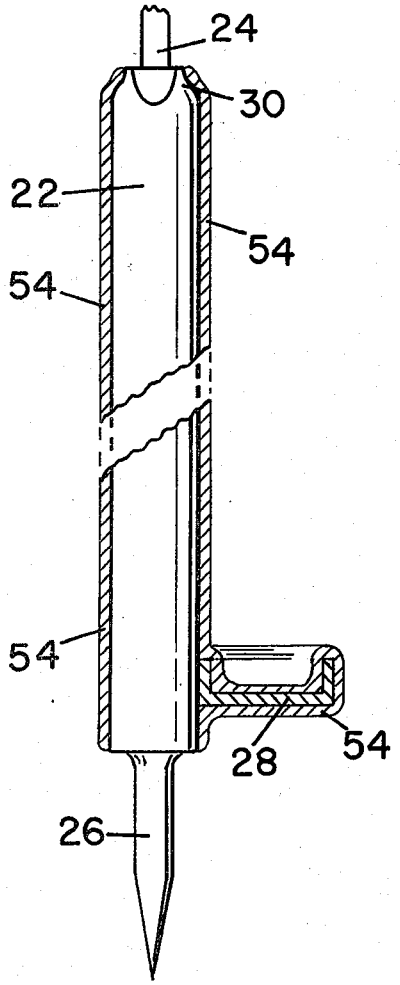
FIG. 10 is a partial section view showing the exterior of the elongated support member encapsulated with rubberized coating.

FIG. 10 shows another embodiment of the portable firearm stand wherein the elongated support member 22 is encapsulated by a protective coating such as a rubberized coating 54. The rubberized coating 54 is provided around the butt support plate 28 and an edge thereon to form a resilient protective surface. The use of a rubberized surface 54 or other type of surface as a protective layer provides means for preventing of the marring, scratching or otherwise defacing the surface of the barrel or butt stock of the rifle or shotgun.

Also, it is noted that the geometrical shape of the butt support member and edge is substantially rectangular in shape. Of course, it is envisioned that the butt support plate could have a different geometrical shape such as that, for example, which generally conforms with the geometrical shape of the butt end of the fixed stock.

What is claimed is:

1. A portable long barrel firearm stand adapted for use with a rifle or shotgun having a barrel and a fixed stock comprising an elongated support member having a hollowed out central area extending axially therethrough, said support member terminating in a pointed stud, said hollowed out central area extending from the pointed stud end to the other end of the support member and terminating in said other end in an aperture which defines a locking guide surface communicating with the hollowed-out central area in a plane substantially perpendicular to the axis of the hollowed out central area;

a guide and alignment support formed into a substantially U-shaped member wherein one leg thereof is an elongated guide support having an external cross section which is adapted to be inserted into and passed through the aperture defining the locking guide surface and adapted to cooperate with the locking guide surface to prevent rotation therebetween, and the other leg thereof defining an alignment support which is substantially shorter than the one leg forming the elongated guide support, said alignment support being spaced a predetermined distance from the elongated guide support, said predetermined distance being equal to that distance required to enable a firearm having a barrel and a fixed stock to be held substantially parallel to the axis of the elongated support member;

a conical shaped, self-aligning support member having a base of the conical shaped portion which is connected to the alignment leg and an apex of the conical shaped portion forming an angular shaped tipped member having an acute angle which is less than 30° which is adapted to be inserted into the opening of a barrel engaging the inner peripheral edge surface of the barrel opening and concurrently aligning and supporting a barrel of a firearm in a substantially parallel relationship relative to the center axis of the elongated support member; and a butt support member fixedly mounted to the elongated support member adjacent the pointed stud, said butt support member being positioned a predetermined distance above the pointed stud to enable the butt end of a fixed stock of a firearm to be inserted into said butt support member, said guide and alignment support being positioned within said elongated support member with the conical support member on the same side as said butt support member, said guide and alignment support being adapted to have the elongated guide member slideably move within said hollowed out central area to form a movable support for a firearm defined by the sides of the conical support member engaging the opening of the barrel and the butt support member and wherein the external surface of the elongated guide member cooperates with the locking guide surface to prevent rotation therebetween due to the rotational moment applied thereto by the weight of the firearm.

2. The portable long barrel firearm stand of claim 1 wherein the geometrical cross section of the aperture defining the locking guide surface and the cross section of the elongated guide member leg of the U-shaped member in the portion thereof cooperating with the aperture defining the locking guide surface are both substantially rectangular in cross dimension.

3. The portable long barrel firearm stand of claim 1 wherein the cross-sectional area of the hollowed out central area of the elongated support member is substantially rectangular in shape terminating in an aperture having a rectangular cross-section and wherein the cross section of the alignment member of the U-shaped member is substantially rectangular in shape throughout its entire length.

4. The portable long barrel firearm stand of claim 1 wherein the butt support member has a raised edge around the periphery thereof.

5. The portable long barrel firearm stand of claim 1 further comprising an oblong shaped dust cap member having a flat cap surface and a raised outer surface defining a rim around the periphery of the flat cap surface, said dust cap being positioned with the alignment member leg extending therethrough and the rim extending toward the butt support member, said dust cap member having a geometrical cross-section to cover two adjacent barrels of a cross-section firearm having a double barrel and a fixed stock.

6. The portable long barrel firearm stand of claim 1 further comprising an adjustable leg support means having a pair of support legs and means for securing the leg support means a predetermined distance above the butt support member, said support legs cooperating with the pointed stud to form a triangular support adapted to hold the elongated support member in a substantially vertical position.

7. The portable long barrel firearm stand of claim 1 further comprising an adjustable rack means including a hook member adapted to be removably secured in a predetermined location in the vicinity of the aperture of the elongated support member.

8. The portable long barrel firearm stand of claim 1 further comprising a protective coating encapsulating the elongated support member and the butt support member providing a resilient exterior surface to prevent engagement between the surface of the elongated support member and the firearm held thereby.

9. The portable long barrel firearm stand of claim 4 wherein the butt support member and the raised edge thereof have a substantially rectangular shaped geometrical dimension for receiving the butt end of a fixed stock of a firearm to be held thereby.

* * * * *